US005523167A

United States Patent [19]

Hunt et al.

[11] Patent Number: 5,523,167

[45] Date of Patent: Jun. 4, 1996

[54] INDELIBLE MAGNETIC TRANSFER FILM

[75] Inventors: David Hunt; Kenny Jordan, both of Wheeling, W. Va.

[73] Assignee: Pierce Companies, Inc., Santa Ana, Calif.

[21] Appl. No.: 294,999

[22] Filed: Aug. 24, 1994

[51] Int. Cl.[6] ..... B41M 5/03

[52] U.S. Cl. ..... 428/484; 428/195; 428/206; 428/207; 428/474.4; 428/488.1; 428/500; 428/532; 428/694 BP; 428/914

[58] Field of Search ..... 428/195, 337, 428/341, 349, 484, 480, 500, 520, 692, 694 B, 206, 207, 474.4, 488.1, 532, 914

[56] References Cited

U.S. PATENT DOCUMENTS

| | | | |
|---|---|---|---|
| 1,692,645 | 11/1928 | Gailer | 428/195 |
| 1,727,912 | 9/1929 | Snyder | 428/195 |
| 3,029,157 | 4/1962 | Sutheim et al. | 428/694 |
| 3,284,360 | 11/1966 | Peshin | 252/62.5 |
| 3,448,052 | 6/1969 | Otto | 252/62.51 |
| 3,496,015 | 2/1970 | Newman et al. | 428/694 |
| 3,677,887 | 7/1972 | Rowsam et al. | 428/195 |
| 4,496,961 | 1/1985 | Devrient | 503/206 |
| 4,520,063 | 5/1985 | Simon et al. | 428/195 |
| 4,936,607 | 6/1990 | Brunea et al. | 503/207 |
| 5,033,773 | 7/1991 | Brunea et al. | 503/207 |
| 5,147,744 | 9/1992 | Sacripante et al. | 430/39 |
| 5,292,593 | 3/1994 | Talvalkar et al. | 428/694 |

*Primary Examiner*—Pamela R. Schwartz
*Attorney, Agent, or Firm*—Price, Gess & Ubell

[57] ABSTRACT

A transfer film comprised of an inert backing coated with a transfer layer comprising a mixture of a resin, a filler, a magnetic pigment, a nondrying oil and an oil soluble dye provides security against fraudulent alteration of Magnetic Ink Character Recognition (MICR) symbols. Upon impact this film acts like an ordinary MICR transfer film: a portion of the transfer layer transfers to a document surface forming a magnetically readable character image. After transfer, the nondrying oil contained in the transferred layer begins to diffuse into the matrix of the document paper. The oil carries the visible oil-soluble dye. Soon an image of the MICR characters appears on the reverse surface of the document. If any of the characters do not show through on the reverse surface as a visible dye image, alterations have been made to the MICR characters.

17 Claims, 2 Drawing Sheets

INDELIBLE MAGNETIC TRANSFER FILM

BACKGROUND OF THE INVENTION

1. Field of the Invention

The present invention relates generally to security of negotiable documents and, more particularly, to an improved transfer film used to print magnetically-readable characters which also bleed through to the reverse side of the document to provide a verification of authenticity.

2. Description of Related Art

Banking institutions lose many millions of dollars each year through check forgery. This problem has existed every since payments by means of checks and bank drafts became common. At one time each check was processed completely by hand. Careful visual inspection was the major barrier to check forgery. Many types of "safety papers" were developed for the printing of check blanks.

These safety papers were designed to change color or otherwise indicate tampering in some visually obvious manner. Typical of these inventions is U.S. Pat. No. 1,727,912 to Snyder. That invention discloses a safety paper of a special structure that allows ink writing to bleed through to the rear surface of the check. A comparison of the rear surface with the front surface will readily reveal any alterations in the check.

Safety paper also forms the subject of more modern inventions. U.S. Pat. No. 4,496,961 to Devrient discloses a paper impregnated with chemical-filled micro capsules. The pressure of writing ruptures these capsule. The chemical contents react to form a dye image of the writing deeply embedded in the paper where it is protected from erasure. However, micro capsules are comparatively expensive to use.

Considerable inventive effort has gone into providing fraud detection for money orders and other negotiable documents that are printed by impact printers. An impact printer, like an old-fashioned typewriter, strikes a pigmented film or ribbon with a hammer in the shape of a character to be printed. This causes an area of the film or ribbon to transfer to the document and create an image of the character. U.S. Pat. Nos. 4,936,607 and 5,033,773 to Brunea et al. disclose an improved security system for impact printing.

Briefly, an inert backing layer is coated with binders, fillers, and pigment like a normal transfer film, to which is added a microencapsulated solvent plus dye. When the film is struck during the printing process, the coated layer transfers to a document surface, creating a visible image due to the pigment. The force of the impact ruptures the micro capsules allowing the solvent to carry the dye through the paper. This results in a dye image on the reverse surface of the document and a "halo" of dye around the primary pigment image on the front surface. It is virtually impossible to alter the primary pigment image and introduce a matching "halo" image. Any alterations are readily visible, thereby preventing forgeries.

However, such an advanced penetrating dye system is not sufficient. Check processing has changed considerably from the days when safety paper alone was an adequate safeguard against forgery. Today virtually all checks are encoded with Magnetic Ink Character Recognition (MICR) symbols. These symbols, usually printed along the lower edge of a check, can be optically read by a human and magnetically decoded by a machine. In the case of manually written checks, the symbols are printed onto the check when the check is returned to the bank for payment.

There has been considerable effort to perfect transfer films for the machines that print (encode) the MICR characters onto checks. Most commonly, MICR characters are printed by a impact printer. A hammer having a raised image of a desired character strikes a transfer film, which then contacts the check or other document. Because the magnetic sensing systems that "read" the MICR character are very sensitive to the magnetic properties of the image, a whole area of the film is actually transferred to the check to form a printed image. This way if the transfer film is manufactured to have proper magnetic characteristics, then the transferred area will likewise have proper characteristics.

A number of United States patents teach the making of a typical MICR transfer film. U.S. Pat. No. 3,029,157 to Sutheim et al. discloses a transfer film wherein an inert backing sheet is coated with a mixture of a grease-like material, a bodying agent (filler), a polymer, a magnetic material, and a solvent. After the solvent evaporates, impact on the film will cause the entire layer of the dried mixture to leave the backing and transfer to a document's surface, providing a magnetically readable character.

It is important that the magnetic characters also be optically readable. To this end, it is desirable to have the transferred layer have sufficient optically density. It is also important that the transferred image not smear or detach from the document surface. Many improvements of the basic transfer film design have been directed to reducing smearing or increasing optical density of the transferred image. For example, U.S. Pat. No. 5,292,593 to Talvalkar et al. represents a recent patent that seeks to improve the basic magnetic transfer film. In that invention, the transfer coating comprises a dye to enhance optical density of the image, a magnetic pigment, a primary amide, optionally an adhesive, and solvents for the coating process.

While these various inventions doubtlessly improve the quality of MICR characters and limit problems due to smearing and/or insufficient printing density, they do little to reduce the problems with forgery or check alteration. Although MICR characters are readable by humans, they are harder to read than ordinary printing and small alterations may be difficult to detect. Generally a check blank comes from a document printing company with the left hand region of the MICR line preprinted with bank, bank account and check number information. The check user adds the amount, payee and signature to the check. The first bank to receive the check encodes the right hand MICR amount field. Fraud can be committed by altering MICR figures in the bank account so that the sum is deducted from the wrong account. Fraud can also take the form of duplicating the entire check with a color copying machine so that the same check can be cashed repeatedly. In addition, the bank customer might alter the amount field after the check has been paid and returned and claim that the check had been encoded improperly.

As mentioned above, the first bank to receive the check reads the amount field and encodes the MICR amount field. But even careful visual inspection of the check may be of little avail in spotting alteration of the MICR line or color copier produced checks. When an altered check is presented for cashing, a cashier might easily fail to detect that there is a change in the bank account number or that the entire check is a fraudulent copy.

OBJECTS AND SUMMARY OF THE INVENTION

It is an object of the present invention to provide a MICR transfer film that can be used in all current devices that impact print MICR characters and provide a measure of protection against alteration of the MICR characters;

It is another object of the present invention to provide a transfer film that prevents fraud by forming a magnetic image on the surface of a document and a migrating dye image visible from the reverse side of the document;

It is a further object of the present invention to provide a magnetic/migrating dye transfer film without having to use expensive microencapsulation technology.

These and additional objects are met by a transfer film comprised of an inert backing coated with a mixture of a resin, a filler, a magnetic pigment, a nondrying oil, and an oil soluble dye to form a transfer layer. Upon impact this film acts like an ordinary MICR transfer film: a portion of the transfer layer transfers to a document surface, forming a magnetically-readable character image. After transfer, the nondrying oil contained in the transferred coating begins to diffuse into the matrix of the document paper. The oil carries the visible oil-soluble dye. Soon an image of the MICR characters appears on the reverse surface of the document. If any of the characters do not show a matching visible dye image, then fraudulent alterations have been made to the MICR characters.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an indelible transfer film for imprinting magnetically readable characters on a document, while at the same time providing a dye which migrates through the document to appear on the reverse side thereof acting as an assurance of the MICR characters authenticity.

Figure 1:
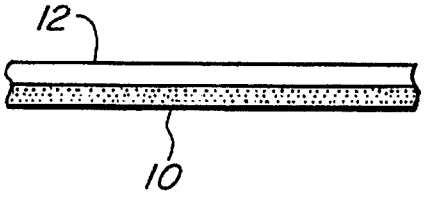
FIG. 1 is a diagrammatic cross section of a transfer film of the present invention.
Figure 2:
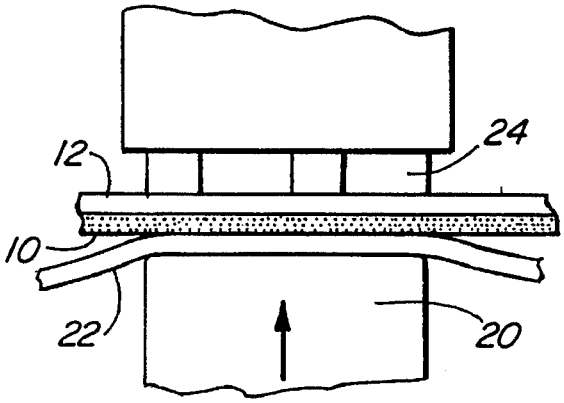
FIG. 2 shows the transfer film of FIG. 1 being struck by a hammer of an impact printer.

As shown in FIG. 1, a typical transfer film is comprised of a transfer layer 10 on an inert plastic film 12 or sheet. The inert plastic can be any of a wide variety of flexible materials such as polyethylene, polypropylene, polyester, polyvinyl, or cellulose ester. The transfer film 10 serves much the same function as a ribbon in a typewriter. As shown in FIG. 2, a hammer 20 strikes a rear surface of a document 22 (i.e., a check) to be imprinted. The impact forces a front surface of the document 22 into contact with the transfer layer 10. A rear surface of the document 22 is forced into contact with a character shape 24. Therefore, the hammer strike "pinches" the document 22 between the transfer layer 10 and the character shape 24. This causes a region 30 (see FIG. 3) of the transfer film 10 in the form of the character shape 24 to leave the plastic film 12 and permanently adhere to the document 22.

The imprinted character is intended to be automatically "read" by a magnetic sensing machine so it must contain a ferromagnetic material. The tolerances of the magnetic sensing process are fairly tight, but by evenly dispersing the magnetic material in the transfer layer and by having the entire layer transfer to the document, controlled magnetic properties are assured. Modern ferromagnetic materials of the proper particle size for use in transfer films are available based on a wide variety of magnetic alloys primarily containing iron, cobalt, manganese, zinc, chromium and various mixtures of these elements.

The magnetic MICR characters are also intended to be read optically by humans. Some commercial ferromagnetic pigments such as MO 4232 or S 0045 are adequately opaque. Alternatively, various pigments such as carbon black can be added to the transfer layer to improve its optical properties.

The bulk of the transfer layer is made of various compounds that keep the ferromagnetic material properly dispersed, that prevent the transfer film from sticking to itself when packaged in rolls, that stick adequately to the document, and that resist smearing. This matrix material or binder material comprises a mixture of waxes and/or resins for adhering to the document surface and for controlling the overall "stickiness" of the transfer layer. The waxes are selected from natural or synthetic waxes of sufficient hardness and ductility such as paraffin waxes, montan, carnauba, and various microcrystalline waxes. Likewise, the resins can be any of a variety of natural and synthetic resins such as vinyl resins, cellulose resins, polyamide resins, and similar resins. The texture of the transfer layer is controlled by the addition of inert fillers such as calcium carbonate, barium sulfate, clay, starch, and like materials.

The inert film is selected for its mechanical properties and for its compatibility with the components of the transfer layer. Normally the components of the transfer layer are dissolved and suspended in an organic solvent for coating on the inert plastic film. Therefore, the film must be resistant to the solvent and must not react with any of the other components of the transfer layer. Typical organic solvents for compounding and coating the transfer layer comprise ethyl acetate, ethyl alcohol, methyl alcohol, N-propanol, toluene, xylene, methyl ethyl ketone, acetone, and a commercial solvent like Skellysolve.

Thus far, a typical magnetic transfer film has been described. However, an important object of the present invention is to provided security against forgery not normally provided by magnetic transfer films. The prior art teaches the use of microencapsulated dye/solvent mixtures to provide an indelible "bleed-through" image that makes the determination of forgery easy. However, no one has provided a magnetic transfer film that incorporates a bleed-through feature so that detecting alteration of MICR characters would be simple. Microencapsulated solvents are relatively expensive and difficult to work with. Furthermore, micro capsules can make the provision of adequate magnetic properties more difficult.

Applicant has discovered that it is possible to provide a bleed-through system without the expense and complexity of micro capsules. Rather than providing a solvent in micro capsules, Applicant includes a substantially nondrying, nonvolatile oil as part of the transfer layer. This oil acts as a plasticizer and affects the mechanical properties of the layer. If the oil were to volatilize like solvents of the prior art, the layer would harden and fail to transfer properly.

Figure 3:
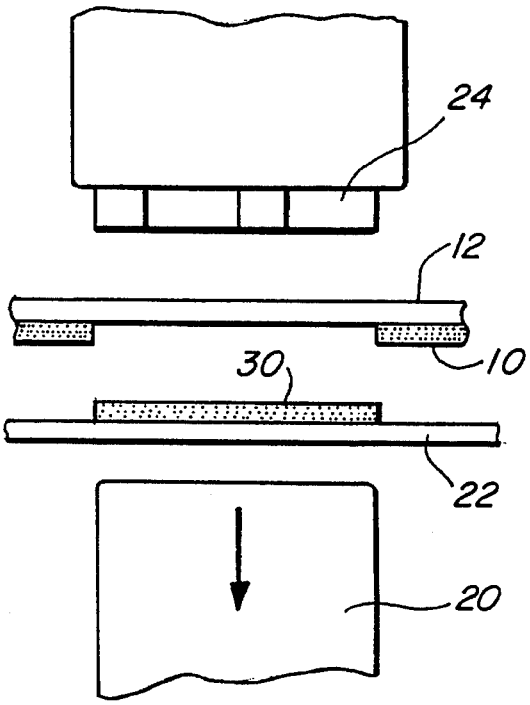
FIG. 3 shows the film of FIG. 1 after transfer to a front surface of a document.
Figure 4:
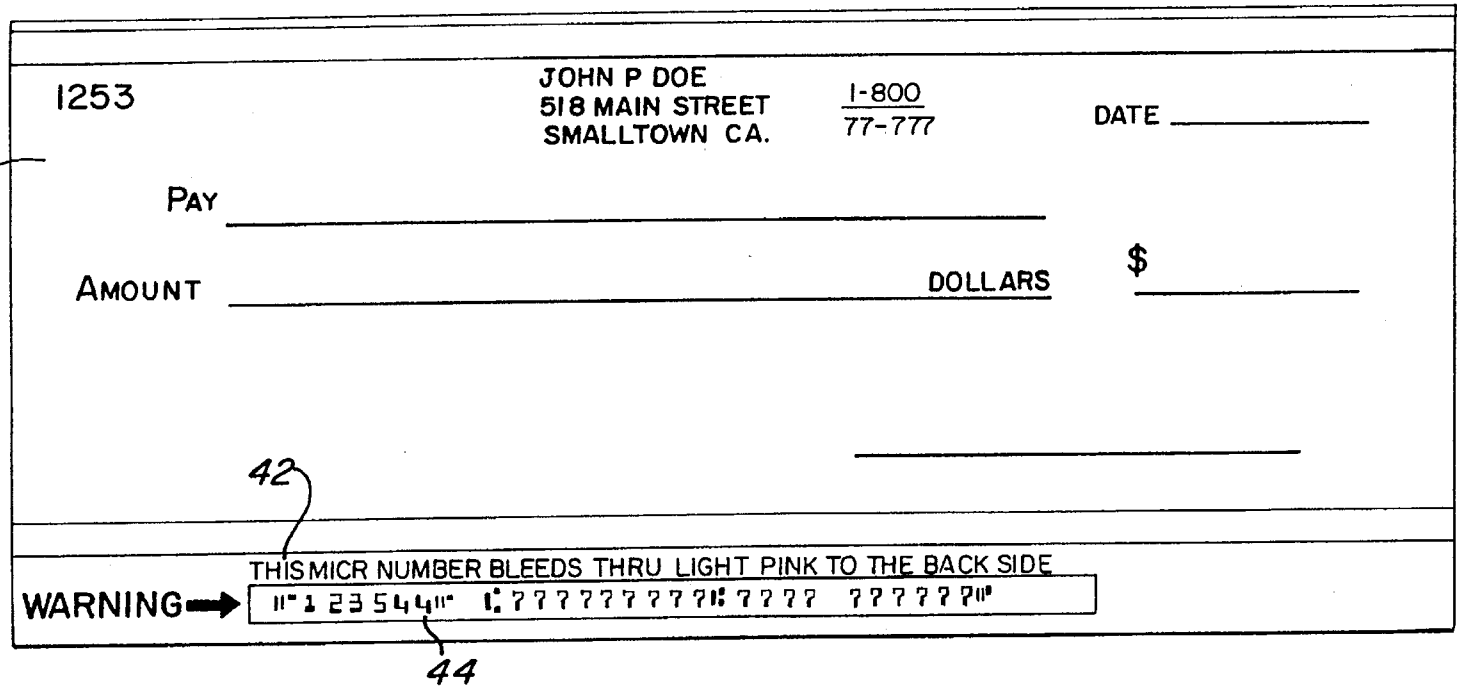
FIG. 4 shows the front surface of the imprinted document.
Figure 5:
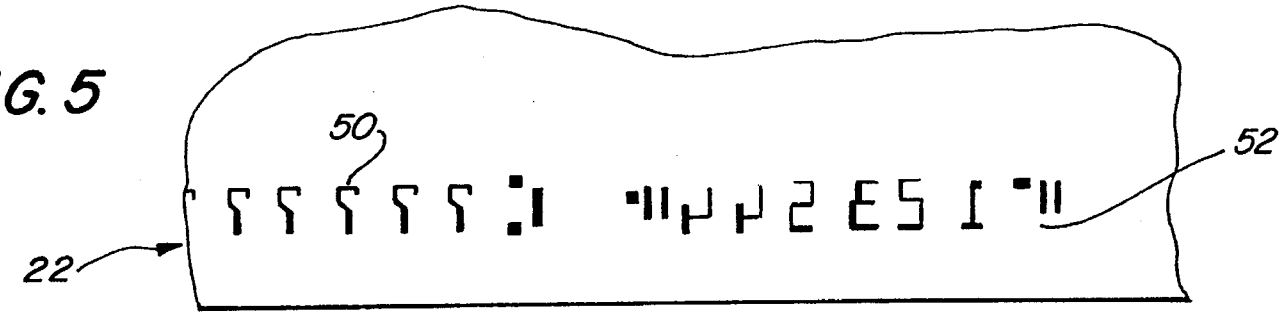
FIG. 5 shows a close-up of a reverse surface of the imprinted document of FIG. 4 after migration of the oil-soluble dye.

The oil acts as wetting agent for pigments, plasticizer for the resins and as a solvent and a delivery vehicle for an antiforgery dye. An organic dye is included in the transfer layer. The dye is oil-soluble and, hence, dissolves in the oil. The dye/oil interacts with and is held by the components of the transfer layer, but after the transfer layer has been transferred to the document surface, as shown in FIG. 3, the oil begins to migrate into the paper, carrying the dissolved dye with it. In this way a dye image of the MICR characters appears on the reverse surface of the document some hours after the imprinting process. A front surface 40 of the document 22 is shown in FIG. 4 after a line 44 of MICR characters has been imprinted with the present invention. A legend 42 reading "THE MICR NUMBER BLEEDS THRU LIGHT PINK TO THE BACKSIDE" informs anyone receiving the check to check for bleed-through to be certain of authenticity. The bleed-through color depends on which organic dye is used, and the legend should be altered accordingly. FIG. 5 is a close-up of a rear surface 52 of the document 22 with a bleed-through line 50 of MICR characters.

A wide variety of potential organic dyes is available. Dyes with a great variety of chemical structures such as xanthene, cyanine, triarylmethane, diarylmethane, phenazine, azo, diazo, anthraquinone, phthalocyanine, quinoline, tartrazine, stilbene, triphenylmethane, nitroso, perylene, pyrazolone, and mixtures of these can be used as long as the dyes are sufficiently oil soluble and light fast. The distance the dye image migrates is primarily dependant upon the amount of oil present in the transfer layer. A larger amount of oil will allow the dye to migrate farther. Thus, by controlling the amount of oil the migrating dye may appear as a "halo" around the MICR characters as well as an image on the reverse side of the document.

Figure 6:
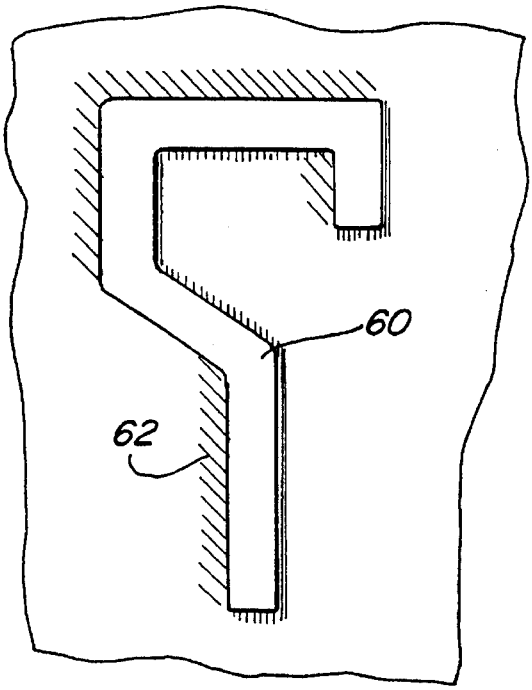
FIG. 6 shows MICR characters and "halo" printed with a transfer film containing two oil-soluble dyes of different colors.

The speed and extent of dye migration also depends on the chromatographic effect of the dye partitioning between the oil and the paper matrix. If an oil or mixture of oils is selected in which the dye is only partly soluble, the dye will migrate slowly and not as far as would a more soluble dye. If the dye molecules are charged or contain polar groups, they will interact more strongly with the predominantly negative charge of most paper matrices and, as a result, migrate more slowly. If both a fast-moving and a slow-moving dye of contrasting colors are included in the transfer layer, a two-toned halo effect will result as shown in FIG. 6. A character image 60 of the slower migrating dye duplicated the character much like the image in FIG. 5. A halo character image 62 is formed by the faster migrating dye. Such a two-color halo is especially difficult for a forger to duplicate even with sophisticated color copy machines.

A wide range of different materials may be compounded with the nondrying, nonvolatile oil, oil soluble organic dye, and ferromagnetic substance to comprise a useful transfer layer. The binder substance of the layer comprises a mixture of resins, waxes and fillers. The resin acts as a film former, and adhesive/cohesive properties of the resin hold the transfer layer together. The wax has some film forming ability, acts as a surface conditioner (i.e., helps resist smearing of the printed image) and acts as a plasticizer. The filler is used for its thixotropic properties as well as an inert material with low oil absorbance. Additional pigments, such as carbon black, may be added to improve the visibility of the imprinted characters. As mentioned above, the type and quantity of oil and dye are selected to control the extent of the dye image's migration.

Many useful oils are prone to slow oxidation ("drying") and such oxidation can impact the transfer ability of the film as well as dye image migration. Therefore, an antioxidation preservative such as butylated hydroxytoluene (BHT) may be added as a stabilizer to prevent oxidation (i.e., rancidity) of the oil component. Other effective preservatives are butylated hydroxyanisole (BHA), propyl gallate, 2,5-di-tert-butylhydroquinone (DTBQ) and mono-tert-butylhydroquinone (MTBHQ). Propyl gallate, DTBQ and MTBHQ also serve to stabilize resins.

The general ranges of useful transfer layer compositions (expressed as weight percentage of the entire layer) is shown in Table I. The various components interact and must be correspondingly adjusted. The choice of materials is made depending on desired properties and on economic factors. For example, although a fairly high percentage of dye may be used, the dye is relatively expensive so that a minimum quantity is generally employed.

TABLE I

| Component | Percentage |
|---|---|
| Ferromagnetic Substance | 25–75 |
| Pigment | 0–20 |
| Wax | 0–60 |
| Resin | 0–60 |
| Filler | 0–40 |
| Oil | 5–50 |
| Preservative | 0–20 |
| Dye | 0.01–20 |

EXAMPLES

The following formulae are given as examples of preferred embodiments. Percentages are given as weight percentages of the materials of the transfer layer. The solvent is expressed in terms of multiples of the total weight of the transfer layer.

EXAMPLE 1

A mixture of 15% UNIREZ 1533 resin (Union Camp polyamide resin), 20% rapeseed (high euratic acid) oil, 5% refined peanut oil, 0.5% BHT as a preservative, 50% S 0045 magnetic pigment (iron oxide, BASF Corp.), 5% Huber 90 filler (kaolin clay, Huber Corp.), 3% Mogul L pigment (carbon black, Cabot Corp.), and 1.5% Neptun Blue 698 (copper phthalocyanine, BASF Corp.) were compounded with an equal weight of N-propanol as a solvent. The solids were first powdered with a ball mill or other attritor. Then the powdered materials were mixed with the liquids. Generally, a ball mill is the preferred method of mixing. The pigment is mixed with the oil; the other solid ingredients are added; and the solvent is added last. Alternatively, the pigment and oil can be ground together, for example in a shot mill, to form a paste. The resin can then be mixed with the solvent in a dispersing mixer (i.e., Hobart or Crowles mixers) to form a lacquer solution. Finally, the paste followed by the filler are mixed into the lacquer solution to form the final coating solution.

The mixture was coated onto 65 gauge polyethylene film and the solvent flash evaporated. The sheets were cut into ribbons and tested in a Maverick printing system on various types of check stock paper. The images were tested for magnetic properties using techniques and standards well known in the check printing art. The magnetic properties and smear resistance of the images were adequate. One hour after printing inspection of the rear surface of the papers showed no bleed-through. After 24 hours bleed-through was quite visible. After 48 hours maximum bleed-through of a light blue image was visible on the rear surface.

This mixture is a preferred embodiment. Polyamide resin-based formulae are generally preferred because, unlike cellulose resin, the polyamide resin does not absorb oil and hence the bleed-through is more rapid and intense. However, a red dye is preferred to blue dye. While any bright color will serve, a color that contrasts with the check stock is preferred. Many checks have a blue background while few have a red background.

EXAMPLE 2

A mixture of 18% CAB 500-5 resin (Cellulose Acetate Butyrate, Eastman Chemical Co.), 2% EHEC x-low resin (cellulose resin, Aqualon Corp.), 20% Emerest 2423 GTO oil, 5% Drakeol 5 oil (low viscosity mineral oil, Penreco Corp.), 0.5% BHT as a preservative, 45% MO 4232 magnetic pigment (iron oxide, ISK Magnetics), 7.5% Huber 90 filler (kaolin clay, Huber Corp.), 1% Sudan Red 380 dye (C.I. Solvent Red 24, BASF Corp.), and 1.0% Neptun Blue 698 dye (copper phthalocyanine, BASF Corp.) were compounded with a three-quarters weight of methyl ethyl ketone and a three-quarters weight of toluene as solvents. The solids were first powdered with a ball mill or other attritor as explained above for Example 1.

The mixture was coated onto 65 gauge polyethylene film and the solvent flash evaporated. The sheets were cut into ribbons and tested in a Maverick printing system on various types of check stock paper. The images were tested for magnetic properties using techniques and standards well known in the check printing art. The magnetic properties and smear resistance of the images were adequate. One hour after printing inspection of the rear surface of the papers showed no bleed-through. After 24 hours bleed-through was quite visible. After 48 hours maximum bleed-through of a light purple image was visible on the rear surface.

EXAMPLE 3

A mixture of 20% EHEC x-low resin (cellulose resin, Aqualon Corp.), 3% rapeseed (high euratic acid) oil, 27% lard, 0.5% BHT as a preservative, 48% MO 4232 magnetic pigment (iron oxide, ISK Magnetics), and 1.5% Basic Violet dye (C.I. 42510) (Dye Specialties, DS 2639) were compounded with a two times weight of ethyl acetate as a solvent. The solids were first powdered with a ball mill or other attritor. Then the powdered materials were mixed with the liquids as explained above for Example 1.

The resulting mixture was coated onto 65 gauge polyethylene film and the solvent flash evaporated. The sheets were cut into ribbons and tested in a Maverick printing system on various types of check stock paper. The images were tested for magnetic properties using techniques and standards well known in the check printing art. The magnetic properties and smear resistance of the images were adequate. One hour after printing inspection of the rear surface of the papers showed no bleed-through. After 24 hours bleed-through was quite visible. After 48 hours maximum bleed-through of a light red image was visible on the rear surface.

EXAMPLE 4

A mixture of 11% EHEC x-low resin (cellulose resin, Aqualon Corp.), 6% Acrowax C (chloroparaffin, Lonza Corp.), 4% 195 White Wax (paraffin, Petrolite Corp.), 5% Carnauba #3 (natural palm leaf wax), 16% rapeseed (high euratic acid) oil, 1% soy lecithin (phosphatidyl choline), 1% MTBHQ (mono-tert-butylhydroquinone, Eastman Chemical Co.) as a preservative, 55% MO 4232 magnetic pigment (iron oxide, ISK Magnetics, and 1% Neptun Blue 698 dye (copper phthalocyanine, BASF Corp.) were compounded with a 1.5 times weight of ethyl acetate and 0.5 times weight of toluene as solvents. The solids were first powdered with a ball mill or other attritor. Then the powdered materials were mixed with the liquids as explained above for Example 1.

The resulting mixture was coated onto 65 gauge polyethylene film and the solvent flash evaporated. The sheets were cut into ribbons and tested in a Fuji Systems printing system with a CMC7 font on various types of check stock paper. The images were tested for magnetic properties using techniques and standards well known in the check printing art. The magnetic properties and smear resistance of the images were adequate. One hour after printing inspection of the rear surface of the papers showed no bleed-through. After 24 hours bleed-through was quite visible. After 48 hours maximum bleed-through of a light blue image was visible on the rear surface.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A pressure-sensitive image-transfer sheet, comprising:

an inert base layer of flexible material; and a transfer layer, for transferring to a front surface of a document, coated upon the base layer, the transfer layer comprising:

a ferromagnetic material for producing magnetic indicia for detection by a magnetic sensing system when the layer is transferred to the front surface of the document;

an oil soluble organic dye for producing visible verification, on a reverse surface of the document, of the authenticity of the magnetic indicia after the layer has been transferred to the front surface of the document;

a substantially nonvolatile, substantially nondrying oil for dissolving the organic dye; and a binder for holding the magnetic pigment, the organic dye and the oil in the layer and for adhering to the front surface of the document when the layer is transferred to the document upon application of pressure to the transfer sheet, and wherein neither said organic dye nor said nondrying oil are microencapsulated.

2. The transfer sheet of claim 1, wherein the inert base layer is selected from the group consisting of polyethylene, polypropylene, polyester, polyvinyl, and cellulose acetate.

3. The transfer sheet of claim 1, wherein the ferromagnetic material comprises between 25% and 75% by weight of the transfer layer and contains a metal selected from the group consisting of cobalt, chromium, iron, manganese, and zinc.

4. The transfer sheet of claim 1, wherein the oil soluble organic dye comprises between 0.01% and 20% by weight of the transfer layer.

5. The transfer sheet of claim 1, wherein the oil soluble organic dye is at least one of the dyes selected from the group consisting of Neptun Blue 698, Sudan Red 380 and Basic Violet 14.

6. The transfer sheet of claim 1, wherein the oil comprises between 5% and 50% by weight of the transfer layer.

7. The transfer sheet of claim 1, wherein the oil is at least one of the oils selected from the group consisting of rapeseed oil, lard, refined peanut oil, mineral oil, and vegetable oil.

8. The transfer sheet of claim 1, wherein the binder comprises at least one of a resin and a wax, and optionally includes components selected from the group consisting of a filler, a pigment, and a preservative.

9. The transfer sheet of claim 8, wherein the binder contains resin and the resin comprises up to 60% by weight of the transfer layer.

10. The transfer sheet of claim 8, wherein the resin is at least one of the resins selected from the group consisting of cellulose resins, polyamide resins, and vinyl resins.

11. The transfer sheet of claim 8, wherein the binder contains wax and the wax comprises up to 60% by weight of the transfer layer.

12. The transfer sheet of claim 8, wherein the binder contains wax and the wax is at least one of the waxes selected from the group consisting of montan wax, paraffin wax, carnauba wax, and microcrystalline wax.

13. The transfer sheet of claim 8, wherein the binder contain filler and the filler comprises up to 40% by weight of the transfer layer.

14. The transfer sheet of claim 8, wherein the binder contains filler and the filler is at least one of the fillers selected from the group consisting of calcium carbonate, barium sulfate, clay, and starch.

15. The transfer sheet of claim 8, wherein the binder contains pigment and the pigment comprises up to 20% by weight of the transfer layer.

16. The transfer sheet of claim 8, wherein the binder contains preservative and the preservative comprises up to and 20% by weight of the transfer layer and is selected from the group consisting of butylated hydroxytoluene, butylated hydroxyanisole, propyl gallate, mono-tert-butylhydroquinone, and 2,5-di-tert-butylhydroquinone.

17. The transfer sheet of claim 1, wherein the oil comprises rapeseed oil and peanut oil, the ferromagnetic material comprises a magnetic pigment, and the binder comprises polyamide resin, butylated hydroxytoluene preservative, kaolin clay and carbon black.

* * * * *